United States Patent [19]

Marks

[11] 4,037,716

[45] July 26, 1977

[54] CARD KEY AND/OR COIN HOLDER

[76] Inventor: John D. Marks, 5077 Moordale Circle, Salt Lake City, Utah 84117

[21] Appl. No.: 698,175

[22] Filed: June 21, 1976

[51] Int. Cl.[2] ..... B65D 75/32; A45C 11/00

[52] U.S. Cl. ..... 206/38; 206/373; 206/484; 70/456 R; 150/37; 150/40

[58] Field of Search ..... 206/38 R, 484, 372, 206/373, 467, 363; 150/40, 37, 35; 70/456 R, 457

[56] References Cited

U.S. PATENT DOCUMENTS

| | | | |
|---|---|---|---|
| 2,756,794 | 7/1956 | Buckett | 150/40 |
| 2,866,542 | 12/1958 | Svirchev | 206/363 |
| 3,012,659 | 12/1961 | Schaar | 206/484 |
| 3,078,986 | 2/1963 | Ushkow | 206/484 |
| 3,144,935 | 8/1964 | Geyler | 70/456 |
| 3,529,649 | 9/1970 | Bennett | 150/40 |
| 3,724,651 | 4/1973 | Link | 206/363 |
| 3,910,410 | 10/1975 | Shaw | 206/363 |

FOREIGN PATENT DOCUMENTS

| | | | |
|---|---|---|---|
| 1,234,664 | 6/1971 | United Kingdom | 206/363 |

*Primary Examiner*—Robert S. Ward, Jr.
*Attorney, Agent, or Firm*—Robert A. Bingham

[57] ABSTRACT

The invention is a pocket-sized card holder for keys, coins and/or similar items comprised of a thin card having a depressed region therein for receiving and containing the items and a pressure resealable, at least partially adhesively-coated lid which covers the depressed region and which can be stripped or peeled back to expose the contained items. The holder is preferably of credit card size for convenience in carrying, with overall thickness only fractionally greater than the items contained.

7 Claims, 3 Drawing Figures

CARD KEY AND/OR COIN HOLDER

The present invention relates to a holder for spare keys and/or coins and other similar-sized items and more particularly to a thin card key and/or coin holder preferably having approximately the same length and width dimensions as a standard credit card and a thickness only fractionally greater than the contained items.

BACKGROUND OF THE INVENTION

Various kinds of spare key holders are common in the art. Some relatively expensive wallets are made with slots in the leather for containing spare keys, but the keys mark or distort the leather and usually are not reliably secured. An improvement of this design has been achieved by the use of plastic inserts, but even then, a portion of the key is exposed to the leather.

Other spare key holders consist of a metal or plastic box equipped with a magnet for attachment to a metal surface. These holders are normally carried in the engine compartment of a motor vehicle. These holders are bulky and their use is so widespread that they have become a security problem due to the limited number of hiding places on vehicles. At least one police department has advised against their use.

Another concealment-type holder consists of simply a piece of adhesive tape used to secure a key to a concealed surface. However, this type of concealment is not portable and is subject to discovery. Another disadvantage of this and other concealment-type holders is that if used with vehicles, the key must usually be placed in a dirty and not readily accessible place.

The present invention, being essentially in credit card form, does not appreciably distort the leather of wallets (and can be carried separately from a wallet) is not bulky and is portable.

Spare key holders in card or rectangular form are known in the prior art, for example, U.S. Pat. No. 2,734,624. However, prior art card key holders contain slots in which keys are inserted. This allows edges or ends of the keys to extend from the surface of the card. Such extensions are cumbersome and can result in the keys catching or binding on other materials contained in wallets or purses where the holder normally is carried. In the present invention, no such extensions are present.

Another defect in prior card key holders is that they hold only keys. The present invention is adapted to contain not only keys but also coins, either separately or simultaneously. Additionally, the present holder can contain safety pins, needle and thread, pins and various other handy items for emergencies. Thus the present holder is significantly more functional than previous holders.

U.S. Pat. No. 3,910,410 discloses a container which operates somewhat similar to the present invention but which is used for an entirely different purpose and is resultantly unnecessarily complex in comparison to the present invention. An important aspect of the present invention is its simplicity and every-day functionality in its intended purposes. Another important aspect is that the invention, in a preferred form, provides for positive retention, without slippage, of the contained items due to contact between the items and the adhesive surface of the lid. U.S. Pat. No. 3,910,410 does not disclose this advantage.

SUMMARY

The present invention relates to a thin, portable card holder for keys, coin and/or similar items comprising a card having a depressed region therein for receiving and containing one or more items and a pressure resealable, at least partially adhesively-coated lid which covers the opening of the depressed region and which adheres to the non-depressed surface of the card. The lid can be repeatedly opened and closed to expose the contained items by stripping the lid from the surface of the card.

DETAILED DESCRIPTION OF THE INVENTION

Figure 1:
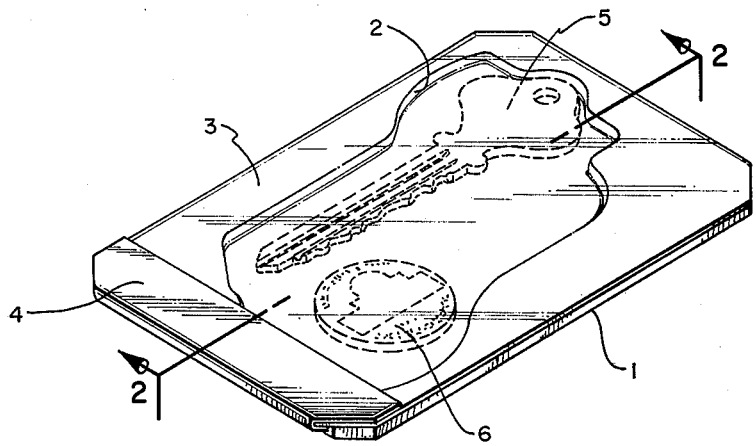
FIG. 1 is a perspective view of the card key and/or coin holder with key and coin in position therein.

FIG. 1 shows a preferred embodiment of the holder of the present invention. Basically, the holder comprises a relatively flat, thin card 1, having a depressed region 2 therein and a pressure resealable, at least partially adhesively-coated lid 3 which covers the depressed region. A tab 4 is also preferably employed.

Figure 3:
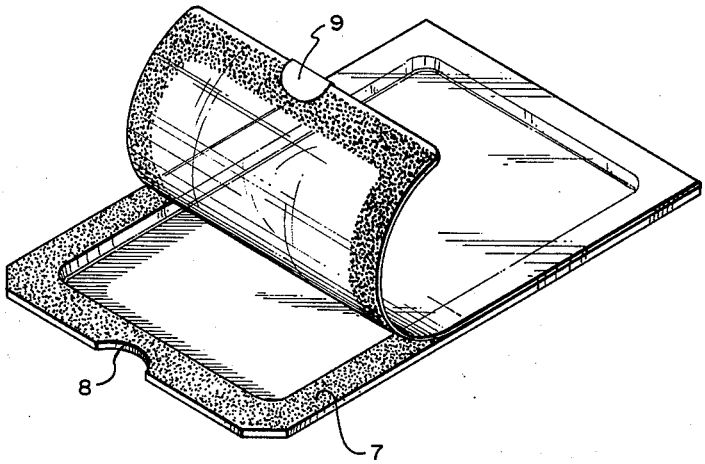
FIG. 3 is a perspective view of a holder, without a key or coin, having a depressed region of different configuration.

The card 1 can be plastic, such as vinyl, metal or other material which possesses card-like stiffness. The card is preferably the size of standard credit card, which has dimensions of approximately 8.57 ± 0.040 cm ($3\frac{3}{8}$ ± 1/64 inches) in length by 5.40 ± 0.040 cm ($2\frac{1}{8}$ ± 1/64 inches) in width, although other dimensions can be used. Credit card size makes for convenient carrying. The card has a depressed region 2 therein within which a key(s) 5 and/or coin(s) 6 or other item(s) can be contained. The depressed region in FIG. 1 conforms to the outline of two juxtaposed and oppositely positioned keys, as is shown. However, any other configuration is possible, and FIG. 3 shows a rectangular configuration. The boundaries of the depressed region can be of any desired size but preferably should not extend closer than about 0.32 cm ($\frac{1}{8}$ inch) to the edges of the card.

An adhesively-coated lid 3 is provided for containing the items within the depressed region. This lid adheres to the non-depressed surface 7 of the card (shown in FIG. 3) and can be stripped or peeled back, as shown in FIG. 3, to expose the contained items. The adhesive is pressure-sensitive so that the lid can be repeatedly resealed to the card for reuse. A preferred lid is an adhesively-backed, clear cellulose acetate. However, any relatively flexible material can be used, such as tape or laminates, clear or otherwise, which has sufficient tensile strength to prevent tearing during peeling or stripping. Mylar polyester is a specific example. The adhesive coating can cover an entire side of the lid or any desired portion thereof so long as the lid effectively contains the items. For example, the adhesive can cover only that portion or subportion directly opposing and contacting the non-depressed surface of the card. Preferably, however, at least some adhesive covers that portion of the lid opposing the contained items in order to adhere to and positively retain the items in position in the depressed region to prevent slippage.

Figure 2:
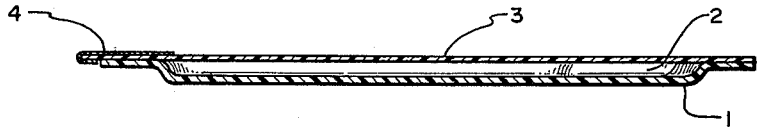
FIG. 2 is a sectional view of the holder, without the key, taken along the line 2—2 of FIG. 1.

Preferably, a tab 4 is affixed to the lid for ease in stripping the lid back from the card. A piece of tape attached to the lid at one end and rounded on the other end where it is gripped for stripping functions well. The tab can extend slightly over the edge of the card as shown in FIGS. 1 and 2. The tab can also extend over a corner of the card to allow stripping from the corner rather than the end. FIG. 3 shows a lid with corners extending over the snipped corners of the card. A tab could be attached to one or both of the overlapping corners of the lid in FIG. 4. Preferably, a notch 8 is placed in the end of the card and a correspondingly-shaped tab 9 extends over it.

The holder should be as a thin as possible, considering the thicknesses of the items to be contained, to appear as much as possible as a credit card so that bulk is minimized. Preferably the thickness of the holder for carrying keys and/or coins is about 0.203 ± 0.064 cm (0.080 ± 0.025 inches).

The advantages of the present invention, in addition to or including those previously mentioned, are its simplicity, reusability, adaptability for containing various emergency items such as spare keys and coins, light weight, portability and convenient size. One particularly advantageous use is by outdoorspeople and sportspeople who need to carry keys with them but do not want to carry a loose key, a bulky key chain, or a wallet. They would need to carry only the present holder. The card holder of the present invention also fits nicely into a wallet among credit cards.

The card base can be manufactured by molding and can be molded in assorted colors to enhance the merchandising appeal of the holder. The lid can also be of various colors.

Although the present invention has been described with reference to illustrative examples and preferred embodiments, various modifications will be apparent to those skilled in the art and any such modifications are intended to be within the scope of the invention as set forth in the appended claims.

What is claimed is:

1. A transferable and portable card holder for keys, coins and/or similar items comprising a rigid card having a depressed region therein for receiving and securely and durably containing one or more items and a pressure resealable, at least partially adhesively-coated lid which covers the depressed region and which adheres to the non-depressed surface of the card, whereby the lid can be repeatedly opened and closed to expose the contained items by stripping the lid from the surface of the card.

2. A holder as defined by claim 1 wherein the depressed region conforms to the outline of two juxaposed and oppositely positioned keys.

3. A holder as defined in claim 1 further comprising a tab affixed to the edge or corner of the lid for use in stripping the lid from the non-depressed surface of the card.

4. A holder as defined in claim 1 in which the end of the card contains a notch over which the lid extends to facilitate the opening of the lid.

5. A holder as defined in claim 1 in which at least part of the surface of the lid opposing the contained items is adhesively coated to positively retain the items in position in the depressed region to prevent their slippage.

6. A holder as defined in claim 1 in which the lid is adhesively coated only on that portion of its surface directly opposing and contacting the non-depressed surface of the card.

7. A holder as defined in claim 1 having approximately the following dimensions: length—8.57 ± 0.040 cm, width—5.40 ± 0.040 cm, thickness—0.203 ± 0.064 cm.

* * * * *